US007707652B2

(12) United States Patent
Senegal

(10) Patent No.: US 7,707,652 B2
(45) Date of Patent: May 4, 2010

(54) EXERCISE SYSTEM AND COMPONENTS

(75) Inventor: Reginald J. Senegal, Portland, OR (US)

(73) Assignee: Level 10 Fitness Products LLC, Portland, OR (US)

( * ) Notice: Subject to any disclaimer, the term of this patent is extended or adjusted under 35 U.S.C. 154(b) by 731 days.

(21) Appl. No.: 11/490,346

(22) Filed: Jul. 19, 2006

(65) Prior Publication Data

US 2007/0083975 A1 Apr. 19, 2007

Related U.S. Application Data

(60) Provisional application No. 60/775,987, filed on Sep. 29, 2005.

(51) Int. Cl.
*A41D 1/04* (2006.01)
*A63B 21/02* (2006.01)

(52) U.S. Cl. ..... 2/102; 482/124

(58) Field of Classification Search ..... 2/102; 482/104, 105, 124; 182/3
See application file for complete search history.

(56) References Cited

U.S. PATENT DOCUMENTS 650,656 A * 5/1900 Raabe ..... 482/124
866,495 A * 9/1907 Marks ..... 482/124
1,402,179 A * 1/1922 Piscitelli ..... 482/124
2,678,447 A * 5/1954 Bracken ..... 2/94
3,004,519 A * 10/1961 Weissman ..... 119/857
3,973,643 A * 8/1976 Hutchinson ..... 182/3
3,999,752 A * 12/1976 Kupperman et al. ..... 482/131
4,121,822 A * 10/1978 DiSabatino et al. ..... 482/88
4,177,877 A * 12/1979 Gallinati ..... 182/3
4,266,300 A * 5/1981 Partridge ..... 2/247
4,273,216 A * 6/1981 Weissmann ..... 182/3
4,382,302 A * 5/1983 Watson ..... 2/102
4,429,419 A * 2/1984 Snyder ..... 2/102
4,445,866 A * 5/1984 Cillieres ..... 434/253
D279,520 S * 7/1985 Brinson, Jr. ..... D29/101.1
4,602,390 A * 7/1986 Morera et al. ..... 2/251
4,658,442 A 4/1987 Tomlinson et al.
RE32,547 E * 11/1987 Reed et al. ..... 119/702
4,860,560 A * 8/1989 Lundelius ..... 70/16

(Continued)

FOREIGN PATENT DOCUMENTS

WO WO2004/014279 2/2004

*Primary Examiner*—Alissa L Hoey
(74) *Attorney, Agent, or Firm*—Klarquist Sparkman, LLP

(57) ABSTRACT

Described herein is an exercise system having wearable components and resistance components. For example, in one illustrative embodiment, an exercise system can include a vest, at least one adjustable band and a resistance device. The vest can have a plurality of anchors and the adjustable band can be worn on a user's arms or legs and have at least one anchor. The resistance device can comprise (a) an anchor attachment section that can be detachably connectable to at least one of the anchors of at least one of the vest and the at least one adjustable band and (b) an object attachment section that can be removably secured to an object. When the anchor attachment section is connected to at least one of the anchors of at least one of the vest and the at least one adjustable band and the object attachment section is connected to an object, the resistance device is capable of resisting movement of a user wearing said one of the vest and at least one adjustable band away from the object.

17 Claims, 9 Drawing Sheets

U.S. PATENT DOCUMENTS 5,002,270 A 3/1991 Shine
5,014,359 A * 5/1991 Hanson ..... 2/94
5,080,191 A * 1/1992 Sanchez ..... 182/3
5,161,486 A * 11/1992 Brown ..... 119/795
5,186,701 A * 2/1993 Wilkinson ..... 482/125
5,211,321 A * 5/1993 Rodriguez ..... 224/604
5,265,782 A * 11/1993 McNamara ..... 2/94
5,306,222 A * 4/1994 Wilkinson ..... 482/124
5,362,295 A * 11/1994 Nurge ..... 482/124
5,397,171 A * 3/1995 Leach ..... 297/484
5,484,366 A * 1/1996 Wilkinson ..... 482/105
5,514,019 A * 5/1996 Smith ..... 441/88
5,544,363 A * 8/1996 McCue et al. ..... 2/102
5,647,827 A * 7/1997 Gutkowski et al. ..... 482/124
5,718,189 A * 2/1998 Blake ..... 119/770
5,720,042 A * 2/1998 Wilkinson ..... 2/69
5,797,143 A 8/1998 Buxton
5,803,667 A * 9/1998 Seligman ..... 405/186
5,813,955 A * 9/1998 Gutkowski et al. ..... 482/124
5,820,533 A 10/1998 Goldman
5,836,310 A * 11/1998 Winters et al. ..... 128/845
5,842,444 A * 12/1998 Perrulli ..... 119/770
5,890,227 A * 4/1999 Brown ..... 2/102
5,893,367 A * 4/1999 Dubats et al. ..... 128/875
5,909,802 A * 6/1999 Puco et al. ..... 2/102
5,950,569 A * 9/1999 Perrulli ..... 119/770
6,024,091 A * 2/2000 Bennett ..... 128/873
6,035,440 A * 3/2000 Woodyard ..... 2/102
6,058,513 A * 5/2000 Simmons et al. ..... 2/312
D426,937 S * 6/2000 Auster et al. ..... D2/830
6,081,924 A 7/2000 Ott
6,122,778 A * 9/2000 Cohen ..... 5/81.1 R
6,132,346 A 10/2000 Weeks
6,192,835 B1 * 2/2001 Calhoun et al. ..... 119/792
6,233,740 B1 * 5/2001 Meyers et al. ..... 2/102
6,287,242 B1 * 9/2001 Fray ..... 482/121
RE37,394 E * 10/2001 Woodyard ..... 2/102
6,314,580 B1 * 11/2001 Greenberg et al. ..... 2/108
6,367,582 B1 * 4/2002 Derby ..... 182/3
6,374,945 B1 * 4/2002 Sherwood ..... 182/3
6,517,214 B1 * 2/2003 Mitchell et al. ..... 362/108
6,551,221 B1 * 4/2003 Marco ..... 482/74
6,554,747 B1 * 4/2003 Rempe ..... 482/38
6,554,752 B2 4/2003 Cook
6,626,131 B2 * 9/2003 Moulton, III ..... 119/770
6,669,608 B1 12/2003 Winston
6,675,391 B2 1/2004 Morrison
6,691,318 B1 2/2004 Davis
6,851,393 B2 * 2/2005 Bremm ..... 119/770
6,883,190 B2 * 4/2005 Carbonneau et al. ..... 5/89.1
7,004,892 B2 * 2/2006 Marco ..... 482/124
7,017,525 B2 * 3/2006 Leach ..... 119/770
7,047,567 B2 * 5/2006 Allen ..... 2/69
7,153,246 B2 * 12/2006 Koscielny et al. ..... 482/121
7,181,772 B2 * 2/2007 Gillen et al. ..... 2/102
7,325,254 B1 * 2/2008 Edgar et al. ..... 2/69
7,384,382 B2 * 6/2008 Farrah et al. ..... 482/124
7,438,653 B2 * 10/2008 Anderson ..... 473/458
7,476,185 B2 * 1/2009 Drennan ..... 482/124
2001/0047533 A1 * 12/2001 Khanamirian et al. ..... 2/102
2003/0019010 A1 * 1/2003 Franco-Sion ..... 2/102
2003/0079271 A1 * 5/2003 Gillen et al. ..... 2/102
2003/0125170 A1 * 7/2003 Vernon ..... 482/124
2003/0192118 A1 * 10/2003 Carbonneau et al. ..... 5/89.1
2004/0000003 A1 * 1/2004 Franco-Sion ..... 2/102
2005/0282689 A1 * 12/2005 Weinstein ..... 482/124
2006/0040805 A1 * 2/2006 Wilkinson ..... 482/124
2006/0168705 A1 * 8/2006 Golle et al. ..... 2/102
2007/0004571 A1 * 1/2007 Gonzalez ..... 482/124
2007/0015640 A1 * 1/2007 Demeniuk ..... 482/124
2007/0017001 A1 * 1/2007 Wagner et al. ..... 2/102
2007/0135278 A1 * 6/2007 Grigoriev et al. ..... 482/124
2007/0219074 A1 * 9/2007 Pride ..... 482/124
2007/0289045 A1 * 12/2007 Evans et al. ..... 2/102
2008/0301863 A1 * 12/2008 Goff et al. ..... 2/467

* cited by examiner

EXERCISE SYSTEM AND COMPONENTS

CROSS REFERENCE TO RELATED APPLICATION

This application claims the benefit of U.S. Provisional Application No. 60/775,987, filed Sep. 29, 2005, which is incorporated herein by reference.

FIELD

This application relates to an exercise system and, in particular, to an exercise system having wearable components and resistance components.

BACKGROUND

Many people participate in various exercises, such as aerobic activities, weight training and functional dynamics, to obtain higher levels of fitness, increased athleticism and rehabilitative modalities. As is common in the fitness industry, basic exercises can be accomplished using machines, e.g., chest press, leg curl, and arm curl machines having attached weight plates and free weights, e.g., dumbbells and barbells with removable weights.

Many athletes, such as professional athletes, participate in more technical and customizable exercises to target sports specific training techniques than basic exercises. For example, sports conditioning or agility and speed training, which include a series of multidirectional movements, are designed to improve an athlete's performance and/or recovery. The effectiveness of such sports conditioning and training exercises can be enhanced by providing resistance to movement. Known devices for providing resistance to motion during multidirectional movement include weighted vests, belts and arm/leg bands.

These devices are partially effective, but have several disadvantages which will become more apparent with reference to the following disclosure. For example, weighted wearable devices are often bulky and cumbersome, which can inhibit a desired motion. Further, weighted devices provide resistance in a limited number of directions and planes of movement.

SUMMARY

The present disclosure is directed toward all new and non-obvious features and method acts disclosed herein both alone and in novel and non-obvious combinations and sub-combinations with one another. The disclosure is not limited to constructions which exhibit all of the advantages or components disclosed herein. The embodiments set forth herein provide examples of desirable constructions and are not to be construed as limiting the breadth of the disclosure.

Described herein is an exercise system having wearable components and resistance components that overcomes many of the disadvantages of the prior art.

For example, in one exemplary embodiment, an exercise vest can comprise a front portion, a back portion, right and left side portions and right and left shoulder portions. The front portion can include a right side open end portion detachably coupleable to a left side open end portion. The exercise vest can also include at least one anchor mechanism comprising (i) an anchor retaining member that extends from a first location on the vest to a second location on the vest and (ii) a repositionable anchor that is movably coupled to the anchor retaining member and configured to detachably receive one or more resistance devices. The repositionable anchor can be selectively movable between the first location and the second location anywhere along a path defined by the anchor retaining member.

In some implementations, the vest can include a plurality of stationary anchors each coupled to one of the front, back, right side, left side, right shoulder or left shoulder portions. The anchors can be configured to detachably receive one or more resistance devices.

In some implementations, the first location can be adjacent one of the front, back, right side, left side, right shoulder and left shoulder portions and the second location can be adjacent another one of the front, back, right side, left side, right shoulder and left shoulder portions.

In some implementations, the front, back, right side, left side, right shoulder and left shoulder portions can form a one-piece construction.

In some implementations, the exercise vest can include a shell section that extends about the front, back, right side, left side, right shoulder and left shoulder portions. The exercise vest can also include a frame section coupled to an external surface of the shell section. The frame section can include at least a first length of webbing that extends circumferentially around and attaches to the front portion, back portion, right side portion and left side portion, and at least a second length of webbing that extends longitudinally around and attaches to the front portion, at least one of the right and left side shoulder portions, and the back portion. In specific implementations, the anchor retaining member and/or at least some of the stationary anchors can be coupled to at least one of the at least first and second length of webbing.

In specific implementations, a substantial portion of the shell section that extends about the front portion can be made of Neoprene, a substantial portion of the shell section that extends about the back portion can be made of a meshed fabric, and the first and second length of webbing can be made of Nylon.

In some implementations, the plurality of stationary anchors can comprise at least one stationary anchor adjacent each of the front, back, right side, left side, right shoulder and left shoulder portions. In a specific exemplary implementation, the plurality of stationary anchors comprises eighteen stationary anchors. The stationary anchors can include (1) first and second stationary anchors adjacent the left side portion; (2) third and fourth stationary anchors adjacent the right side portion; (3) fifth and sixth stationary anchors adjacent a lower portion of the front portion; (4) seventh and eighth stationary anchors adjacent an upper portion of the front portion; (5) ninth and tenth stationary anchors adjacent an intermediate portion of the front portion between the fifth and sixth stationary anchors and the seventh and eighth stationary anchors; (6) an eleventh stationary anchor adjacent the left shoulder portion; (7) a twelfth stationary anchor adjacent the right shoulder portion; (8) a thirteenth stationary anchor adjacent an upper middle portion of the back portion; (9) a fourteenth stationary anchor adjacent a lower middle portion of the back portion; (10) a fifteenth stationary anchor adjacent an intermediate middle portion of the back portion between the thirteenth and fourteenth stationary anchors; (11) sixteenth and seventeenth stationary anchors adjacent the back portion between the eleventh and twelfth stationary anchors and the thirteenth stationary anchor; and (12) an eighteenth stationary anchor movable between a position adjacent the left side portion and a position adjacent the right side portion.

In some implementations, the repositionable anchor can be slidably coupled to the anchor retaining member, and wherein the repositionable anchor is selectively slidable between the first location and the second location. In some implementations, the first location can be adjacent the left side portion and the second location can be adjacent the right side portion.

In some implementations, the exercise vest can include at least one weight pocket coupled to an interior surface of at least one of the front, back, right side and left side portions.

In one exemplary implementation, an exercise device wearable on an arm or leg of a user can comprise a first length of material that has a first end and a second end. The exercise device can also have a second length of material that has at least a first portion secured to the first length of material and a second portion secured to the first length of material at a location away from the first portion such that a third portion of the second length of material between the first and second portions is unattached to the first length of material. The exercise device can have at least one ring that is configured to receive at least one resistance device. The ring can be retained by and slidable along the third portion of the second length of material between the first and second portions anywhere along a path defined by the third portion. In some implementations, the exercise device can include a coupling mechanism that is configured to secure the first and second ends of the first length of material in at least close proximity to the second end of the first length of material such that the first length of material is capable of forming an at least partially annular shape having a circumferential dimension.

In some implementations, the third portion of the second length of material can have a length of at least one-third the circumferential dimension.

In some implementations, the exercise device can include at least one stationary ring coupled to the first length of material.

According to one exemplary embodiment, a resistance device for exercising can include a coupler and an anchor attachment section that comprises at least one resilient member coupled to the coupler at a first end. The anchor attachment section can have an attachment device at a second end opposite the first end where the attachment device is capable of removably securing a portion of an exercise device. The resistance device can also include an object attachment portion that comprises a length of non-elastic material having a first end coupled to the coupler and a object attachment device at a second end opposite the first end. The object attachment device can be capable of being removably secured to a fixed object. When the attachment device is secured to a portion of an exercise device and the object attachment device is secured to an object, the at least one resilient member can be capable of resisting movement of an exercise device away from a fixed object.

In some implementations, the object can be a person and the object attachment device can be a handle capable of being gripped by the person.

In some implementations, the anchor attachment section can comprise a plurality of resilient members. In specific implementations, at least two of the plurality of resilient members have a different length. In specific implementations, the anchor attachment section can comprise five resilient members. A first resilient member can have a first length, second and third resilient members each can have a second length different than the first length, and fourth and fifth resilient members each can have a third length different than the first and second lengths.

In some implementations, the coupler is an annular ring.

In one exemplary embodiment, an exercise system can include a vest, at least one adjustable band and a resistance device. The vest can be wearable by a user and comprise a front portion, a back portion, right and left side portions and right a left shoulder portions forming a one-piece construction. The front portion can comprise a right side open end portion detachably coupleable to a left side open end portion. Further, the vest can have a plurality of anchors. In some implementations, at least one of the plurality of anchors can be a repositionable anchor movable about an exterior of the vest between two predetermined locations on the vest.

The at least one adjustable band can be wearable by a user on at least one of the user's arms and legs and include at least one anchor. In certain implementations, the at least one anchor is a repositionable anchor movable about an exterior of the band between two predetermined locations on the band.

The resistance device can comprise an anchor attachment section that has at least one elastic member coupled to an attachment device, which can be detachably connectable to at least one of the anchors of at least one of the vest and the at least one adjustable band. The resistance device can also comprise an object attachment section that includes a length of non-elastic material coupled to the anchor attachment section at a first end and an object attachment device at a second end opposite the first end. The object attachment device can be capable of being removably secured to an object.

When the anchor attachment section is connected to at least one of the anchors of at least one of the vest and the at least one adjustable band, and the object attachment section is connected to an object, the resistance device can be capable of resisting movement of a user wearing the at least one of the vest and the at least one adjustable band away from the object.

In some implementations, the object can be an exercise machine. In some implementations, the anchor attachment section can include a plurality of elastic members. Each elastic member can be coupled to at least one of the plurality of anchors of the vest via an associated attachment device.

The foregoing features and advantages of the exercise system will become more apparent from the following detailed description, which proceeds with reference to the accompanying figures.

DETAILED DESCRIPTION

Figure 1:
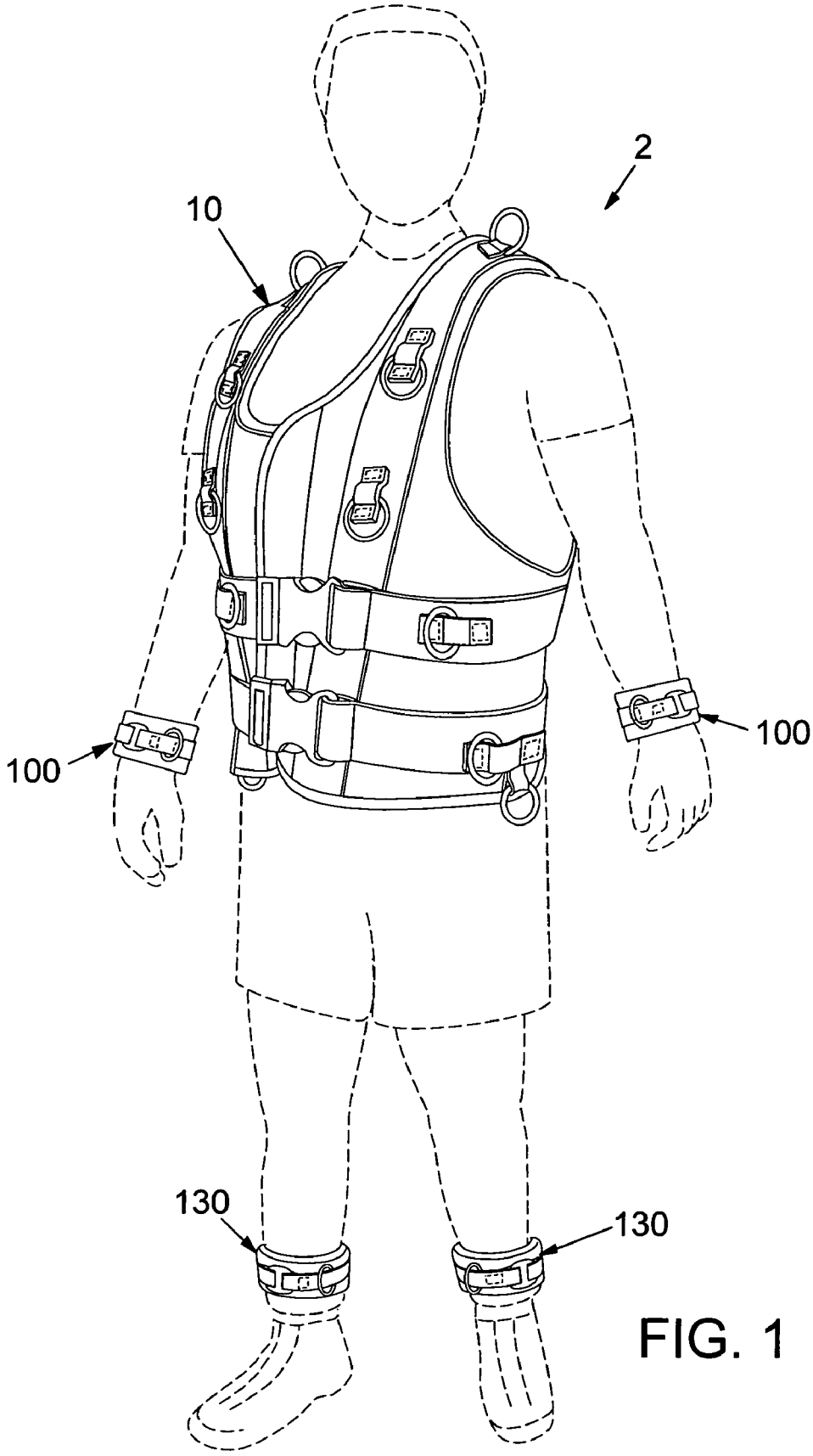
FIG. 1 shows a person wearing exemplary embodiments of an exercise vest, arm bands and leg bands.

Described herein are embodiments of an exercise system and one or more components of an exercise system. The exercise system is customizable to allow a user to participate in any of a number of workouts or exercises. The exercise system can include multiple, individually customizable components, such as an exercise vest, arm bands, leg bands and a resistance device. For example, as shown in FIG. 1, according to one exemplary embodiment, an exercise system 2 can include an exercise vest 10, arm bands 100 and leg bands 130. The exercise vest 10 is configured to be worn on a person's upper body as shown with the arm and leg bands 100, 130 being attachable to a portion of a person's arms and legs, respectively, as will be described in more detail below.

The exercise vest 10 is designed to facilitate assistance or resistance in functional exercise and rehabilitation training. Desirably, the exercise vest 10 is sleeveless. However, it is recognized that is some implementations, the exercise vest can have sleeves.

Figure 2:
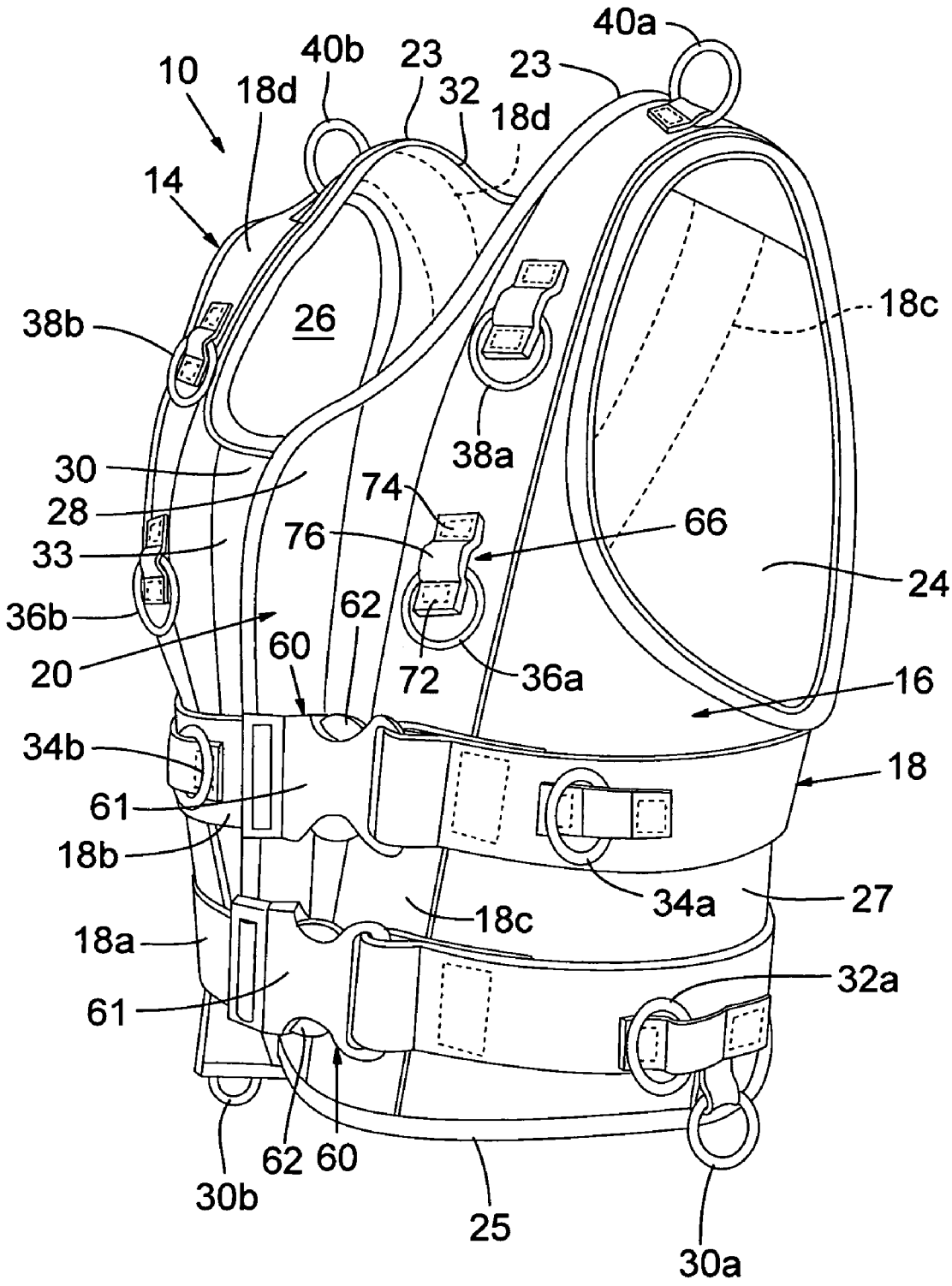
FIG. 2 is a perspective view of the exercise vest of FIG. 1 showing a front portion of the vest.
Figure 3:
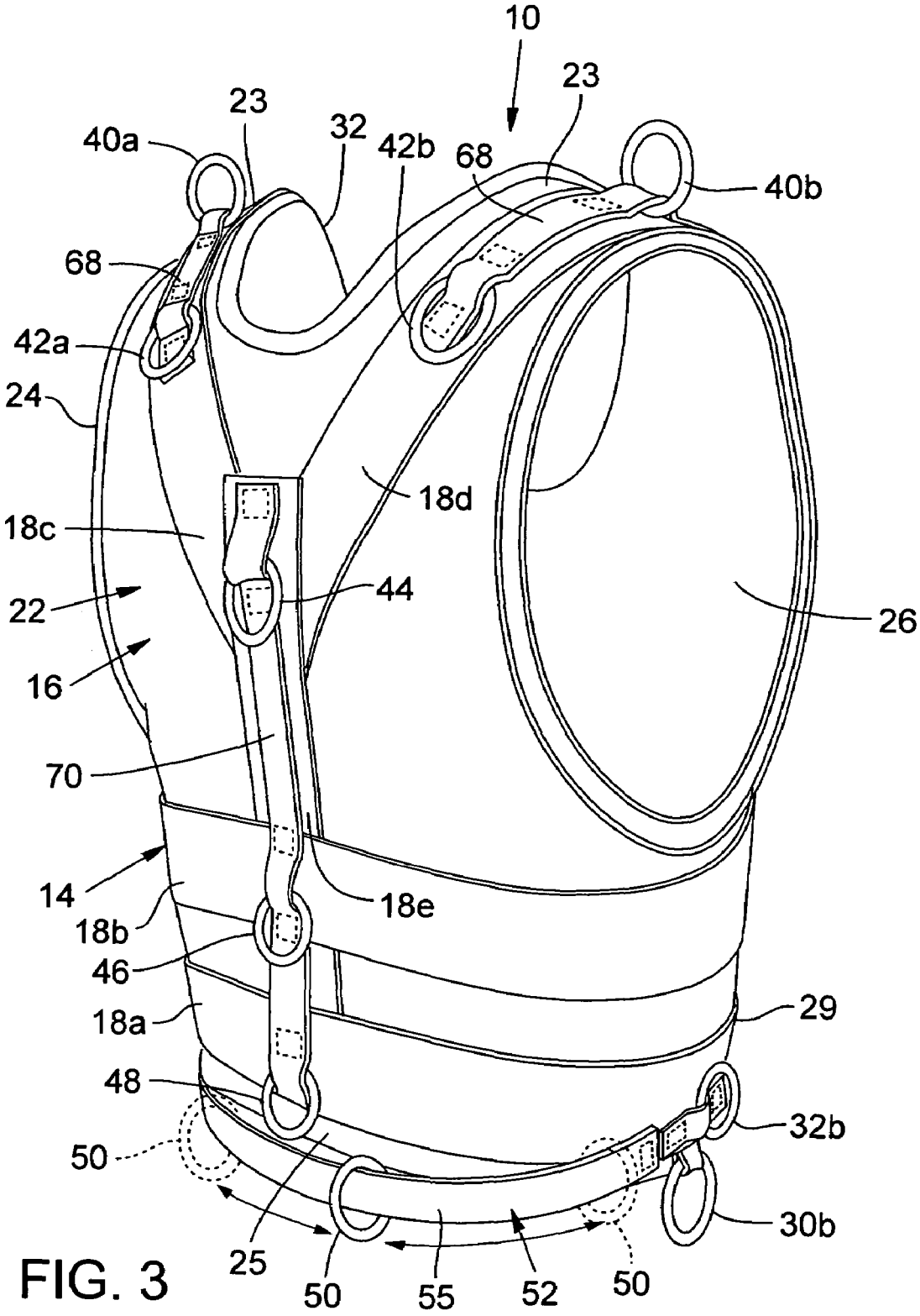
FIG. 3 is a perspective view of the exercise vest of FIG. 1 showing a rear portion of the vest.

Referring to FIGS. 2 and 3, the vest 10 can be made up of a front or anterior portion 20, a back or posterior portion 22, shoulder portions 23, lower portion 25, left side portion 27 and right side portion 29. In the illustrated embodiments, the front portion 20, back portion 22, shoulders portions 23, lower portion 25, left side portion 27 and right side portion 29 form a one-piece unitary construction. As used herein, one-piece construction can be defined to mean one or more sections inseparably connected, i.e., not reversibly separable or unable to separate without destruction to or impairing the use of one or more of the sections.

In one exemplary implementation, the exercise vest 10 comprises a frame section 14 and a shell section 16 coupled to the frame section.

In the illustrated embodiments, the frame section 14 includes several lengths of generally non-stretchable or non-resilient webbing 18 interconnected together to form an at least partially rigid framework to which the shell section 16 can be attached. The webbing 18 can be, but is not limited to, nylon webbing, such as 2-inch wide nylon webbing.

Each length of webbing 18 extends about the vest over a particular part of the user's body donning the vest. For example, webbing 18*a*, 18*b* are disposed generally parallel to each other and extend circumferentially about the vest 10 from first ends proximate a left side open end portion 28 of the vest, around the left side portion 27, back portion 22 and right side portion 29 to second ends proximate a right side open end portion 30 of the vest 10 (see also FIG. 4). When worn, the webbing 18*a*, 18*b* extends over a lower abdomen area and an upper abdomen area of the body, respectively. Webbing 18*c*, 18*d* extends upwardly from the lower portion 25 of the vest 10 to respective shoulder portions 23 and downwardly from the shoulder portions to converge at a location on the back portion 22 of the vest. In other words, when the vest is worn by a user, webbing 18*c*, 18*d* extends over the lower abdomen area, the upper torso areas, the lower chest areas, the upper chest areas, the shoulder areas, and the back areas of the right hand side and left hand side of the body, respectively. Finally, webbing 18*e* can extend generally transversely to the webbing 18*a*, 18*b* along the back portion 22 of the vest 10 over a back or spine portion of the body from the webbing 18*c*, 18*d* to the webbing 18*a*.

The shell section 16 can comprise an at least partially flexible material to which the lengths of webbing 18 are attached, and can provide comfort and conformabilty to the user. When worn, the shell section 16 proximate the front portion 20 of the vest 10 approximately covers the anterior portion of the torso of the user's body and the shell section 16 proximate the back portion 22 of the vest 10 approximately covers the posterior portion of the user's torso.

The shell section 16 includes opposing left and right arm openings 24, 26, respectively, disposed at least partially between the front and back portions 20, 22, shoulder portions 23, and respective left side and right side portions 27, 29 of the vest 10. The left side open end portion 28 and the right side open end portion 30 form part of the shell section 16 of the vest 10. The open end portions 28, 30 can be coupled together such that a head and neck opening 32 is defined between the front portion 20, back portion 22 and shoulder portions 23.

In some implementations, the corresponding open end portions 28, 30 are removably attached to each other to at least partially secure the vest 10 to the user's body. For example, in the illustrated embodiments, the end portions 28, 30 are removably secured to each other by a conventional hook and loop fastening mechanism, such as Velcro®. More specifically, in one implementation, a length of material 31 having a plurality of hooks can be attached to an interior of the shell section 16 proximate the end portion 28 and a corresponding length of material 33 (see FIG. 2) having mating loops can be attached to an exterior of the shell portion proximate the end portion 30. In this manner, the end portions 28, 30 can be removably attached by placing the end portion 28 over the top of and against end portion 30.

Unless otherwise indicated, as used herein, the terms "removably attachable," "removably attached," "removably secured," and the like, are defined to mean easily removable or easily detachable from an object, and easily attachable to an object, without violence to the object or the attaching device such that the object and device remains functional.

Although a hook and loop fastening system is shown, in other implementations, the end portions 28, 30 can be removably attached to each other using other, or additional, fastening mechanisms, such as conventional buttons, snap buttons, one or more zippers, string or lace, clips or other conventional fastening mechanisms having two or more matable portions allowing for easy attachment to and detachment from each other. For example, the left and right sides of the front portion 20 of the vest 10 can be coupled together to at least partially secure the vest on a user by mating butterfly clips 60 attached to opposite ends of the webbing. For example, the left side ends of the webbing 18*a*, 18*b* can have first female attachment portions 61 of clip 60 and the right side second ends can have corresponding second male attachment portions 62 that are matingly received and secured in the first female attachments portions, respectively. To accommodate users with different body sizes and shapes, the circumferential length of the webbing 18*a*, 18*b* can be increased or decreased by adjustably threading either the right or left side ends through a respective first male and/or second female attachment portion, respectively.

In the illustrated embodiments, the front portion 20 of the shell section 16 is made of a resiliently or elastically flexible material, such as, but not limited to, Neoprene®. The front portion 20 can be fixedly attached, such as by sewing, to the back portion 22 of the shell section 16, which can be made of, for example, a meshed fabric. The meshed fabric can provide enhanced breathability of the vest when compared to non-meshed fabrics. In other embodiments, the front and rear portions can be made from a single piece of material to form a one-piece seamless construction.

The exercise vest 10 can include a plurality of anchors, or rings, 30-50 for receiving one or more resistance devices. Each of the anchors 30-50 is positioned in a strategic location on the vest 10 to accommodate various exercises and movements. In the illustrated embodiments, stationary anchors 30-48 are secured to the vest 10 by one or more fabric strips. As shown, some strips facilitate the securing of a single ring, e.g., strip 66 (see FIG. 2), some strips facilitate the securing of two rings, e.g., strip 68 (see FIG. 3), and some facilitate the securing of three rings, e.g., strip 70 (see FIG. 3). Although the illustrated embodiments have strips for securing one, two and three rings, it is recognized that in some implementations, each ring can be secured by a single strip or more than three rings can be secured by a single strip. As defined herein, stationary anchors refer to anchors that are either immovable or movable, such as pivotable or rotatable, in place. In other words, although capable of being moved, stationary anchors are confined to movement at a specific location on the vest and cannot move between two separate locations on the vest, such as from one portion of the vest to another portion.

The strips are fixedly attached to the frame section 14 of the vest. Preferably, at least two spaced-apart attached portions, e.g. spaced-apart portions 72, 74 of exemplary strip 66, are sewn to the frame section 14 such that a ring receiving portion, e.g., ring receiving portion 76, intermediate the spaced-apart attached portions is unattached or unsewn to the frame section (see FIG. 2). Each ring receiving portion extends through a respective ring such that when the spaced-apart attached portions are attached to the frame section 14, each ring is disposed and pivotably contained within each ring receiving portion at a specific portion of or location on the vest 10 (see, e.g., FIG. 2). The fabric strips 66, 68, 70 can be made from a length of durable material, such as Nylon®.

When the vest is worn by a user, the anchors 30-48 are positioned on the vest at specific portions of the vest corresponding to the portion of the user's body over which the anchors are positioned. For example, in one specific illustrative embodiment shown in FIG. 2, lower waist anchors 30*a*, 30*b* are attached to the lower abdomen webbing 18*a* at side portions 27, 29, respectively, of the vest 10, i.e., approximately adjacent or over the lower portion of a left and right side of a user's waist. Upper waist anchors 32*a*, 32*b* are attached to the lower abdomen webbing 18*a* at side portions 27, 29, respectively, of the vest above the lower waist anchors 30*a*, 30*b*. Frontal mid-torso anchors 34*a*, 34*b* are attached to the upper abdomen webbing 18*b* intermediate the side portions 27, 29 and the open end portions 28, 30, respectively, of the vest 10. Lower chest anchors 36*a*, 36*b* are attached to the webbing 18*c*, 18*d*, respectively, at a position on the vest 10 intermediate the shoulder portions 23 and the upper abdomen webbing 18*b*. Upper chest anchors 38*a*, 38*b* are attached to the webbing 18*c*, 18*d*, respectively, at a position on the vest 10 intermediate the lower chest anchors 36*a*, 36*b*, respectively, and the shoulder portions 23. Shoulder anchors 40*a*, 40*b* are attached to the webbing 18*c*, 18*d*, respectively at respective shoulder portions 23 of the vest 10.

The back portion of the vest 10 as shown in FIG. 3 includes upper back anchors 42*a*, 42*b* attached to the webbing 18*c*, 18*d*, respectively, at a position on the vest 10 intermediate the shoulder portions 23 and an upper spine anchor 44. The upper spine anchor 44 is attached to the webbing 18*e* at an upper back portion of the vest intermediate the upper back anchors 42*a*, 42*b* and the upper abdomen webbing 18*b*. A middle spine anchor 46 is attached to the webbing 18*e* at a middle portion of the back intermediate the upper spine anchor 44 and the lower abdomen webbing 18*a*. A lower spine anchor 48 is attached to the webbing 18*e* at a lower portion of the back intermediate the middle spine anchor 46 and a lower back slidable anchor 50.

In the exemplary embodiment shown in FIG. 3, the lower back slidable anchor 50 is slidably coupled to the vest by an elongate strip 52 made from a length of durable material. As shown, the strip 52 is attached to the lower abdomen webbing 18*a* at the lower right side portion 29 of the vest 10 at a first end, extends generally across the back portion 22 of the vest, and is attached to lower abdomen webbing at the lower left side portion 27 of the vest at a second end. The portion of the strip 52 intermediate the first and second ends is unattached to the vest to provide an anchor track, or guide, 55 along which anchor 50 is allowed to slide, or otherwise move. The strip 52 is threaded through the anchor 50 prior to being attached to the vest such that when the strip is attached to the vest, the anchor 50 is captured between the first and second ends of the strip. The anchor 50 is thereby allowed to slidably move across the lower back portion of the vest between the first and second ends of the strip of material, and the lower left and right side portions 27, 29, respectively, of the vest 10.

Figure 3A:
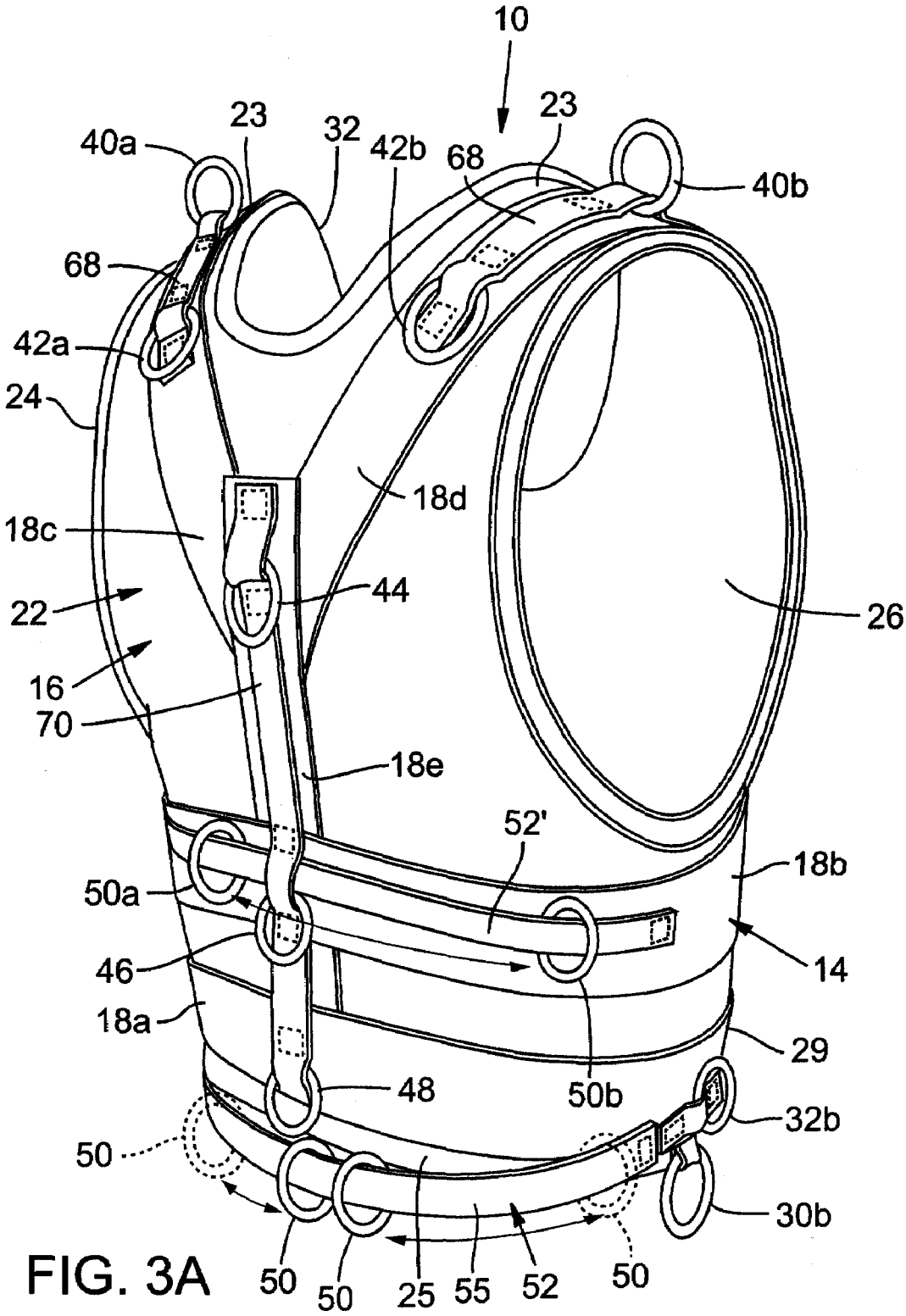
FIG. 3A is a perspective view of an alternative embodiment of an exercise vest.

Although only a lower back slidable anchor 50 that is slidable between the lower left and right side portions 27, 29, respectively, of the vest 10 is shown in FIG. 3, it is recognized that in other embodiments, the exercise vest can include one or more slidable anchors slidable between other portions of the vest. For example, FIG. 3A shows that an elongate strip 52' similar to strip 52 can be attached to the upper abdomen webbing 18*b* at the right side of the back portion 22 of the vest 10 at a first end and the upper abdomen webbing at the left side of the back portion of the vest. An anchor or ring, such as anchor 50, can be coupled to the strip and slidable between the left and right sides of the back portion of the vest. Similarly, in some implementations, one or more elongate strips and anchors can be positioned on the webbing of the vest such that an anchor can be slidable between other portions of the vests, such as, for example, between the upper back portion and the lower back portion of the vest, between the left shoulder portion and right shoulder portion of the vest, between the left shoulder portion and lower right side portion of the vest, and between the right shoulder portion and lower left side portion of the vest.

Further, although one slidable anchor coupled to a single elongate strip is shown in FIG. 3, it is recognized that in some implementations, more than one slidable anchor 50A, 50B can be coup led to a single elongate strip (FIG. 3A). In certain implementations where a single elongate strip facilitates multiple anchors, the anchors can be movable between a first attached end and a second attached end of the strip. In other specific implementations, the elongate strip can be attached to the vest at a first end, second end and one or more locations intermediate the first and second end to create two or more slidable anchor tracks or guides, with each track or guide facilitating slidable movement of one or more anchors.

Although the anchors 30-50 are shown as rings attached to the frame section 14 by a strip of fabric, such as nylon, it is recognized that other attachment mechanisms can be used, such as plastic or metal footings removably or irremovably secured to the frame section 14 and to which the rings can be movably secured.

Figure 4:
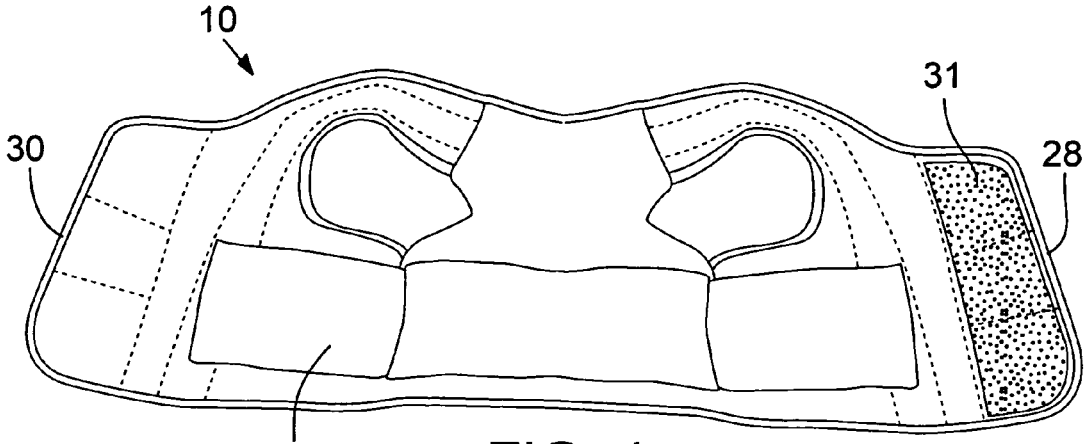
FIG. 4 is a perspective view of the interior of the exercise vest of FIG. 1.

Referring to FIG. 4, in some implementations, one or more pockets 60 can be formed in, removably attached or fixedly attached to a surface of the vest. The pockets can be patterned after conventional pockets and include at least one open side or top end for receiving free weights. The open side or top end can be adjustably closable to contain the weights within the pocket.

In the illustrated exemplary embodiment shown in FIG. 4, the pocket 60 is made from a length of material, such as a fabric, extending circumferentially about the vest and having a bottom edge or end, and at least a portion of the side ends, sewn to the interior surface of the vest 10. The top end is removably attachable to the interior surface of the vest by a first strip of Velcro® attached to the vest and a second mating strip attached to the top end of the pocket.

For a user wearing the vest during a workout, weights can be placed within the pockets to provide additional resistance to movement and thus, further development or strengthening of particular areas of the body. The pockets can also receive any of various buoyant objects to provide at least partial flotation of a user wearing the vest while participating in any of various water activities, such as swimming.

Figure 5:
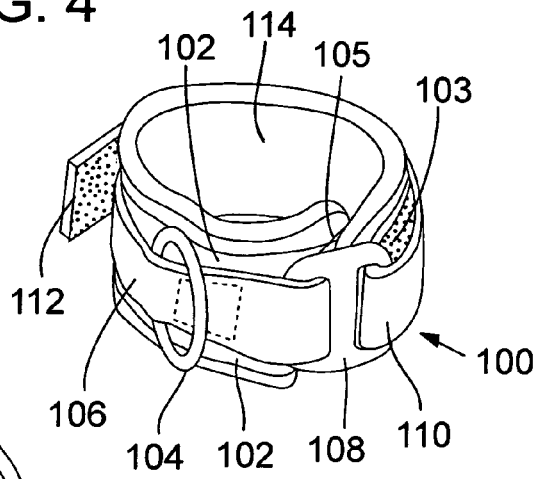
FIG. 5 is a perspective view of one of the arm bands of FIG. 1 in a closed configuration.
Figure 6:
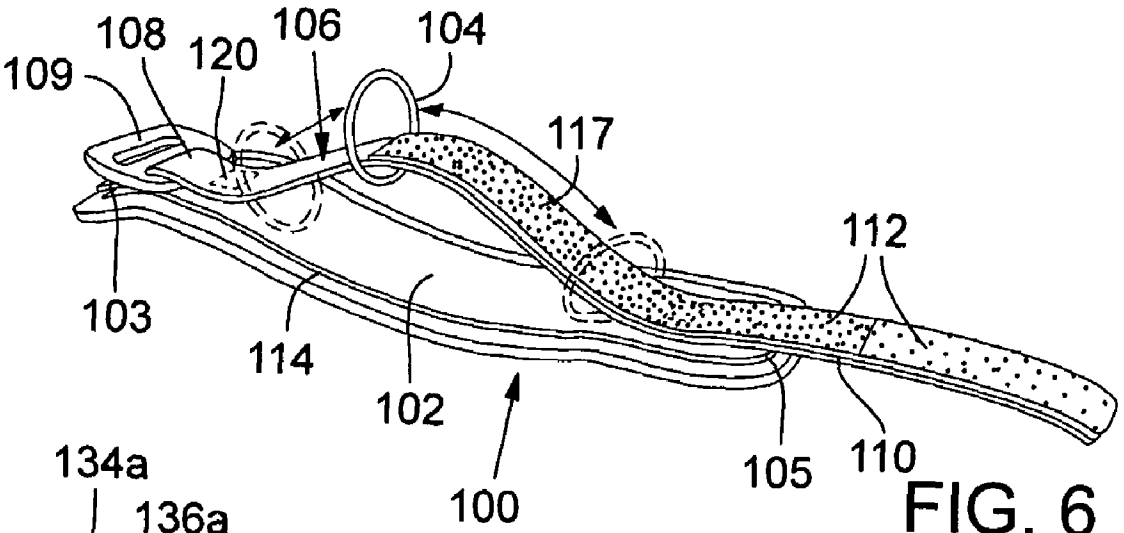
FIG. 6 is a perspective view of one of the arm bands of FIG. 1 in an open configuration.

Referring now to FIGS. 5-8, arm bands 100 and leg bands 130 are shown and now described in more detail. FIG. 5 shows an exemplary embodiment of an arm band 100 in a closed configuration, i.e., the configuration of the arm band when worn on a user's arm during use, and FIG. 6 shows an exemplary embodiment of the arm band in an open configuration such as when not in use. Generally, the arm band can comprise a length of material having a first end coupleable to a second end via a fastening mechanism to form a band or loop about a user's arm. The arm band further includes at least one anchor for receiving one or more resistance devices. More specifically, in one exemplary embodiment, arm band 100 can include a length of webbing 102 having a first end 103 and a second end 105.

The arm band 100 can include at least one anchor 104 attached to the webbing 102 by a strip of material, e.g., strip 106, in a manner similar to that described above in relation to anchors 30-48 of vest 10. In some implementations, the anchor, or anchors, and associated strip of material attached to the webbing 102 are movable, but remain at a specific location on the webbing 102, such as anchors 30-48 of vest 10. Alternatively, as shown in the illustrative embodiments, the strip, e.g., strip 106, can include an anchor guide, or track, 117 extending a length of the band 100 and along which an anchor, e.g., anchor 104, can slide, or otherwise move, such as circumferentially about the band, from one location on the band to another location.

In specific implementations, for example, a first portion 120 of the strip 106 can be attached, such as by sewing, to the webbing 102 proximate the first end 103 and a second portion 122 of the strip 106 can be attached to the webbing proximate the second end 105. The portion of the strip 106 intermediate the attached first and second portions 120, 122, respectively, can define an anchor guide 107 for anchor 104. The strip 106 has a length such that a first open end portion 109 extends away from the first portion 120 proximate the first end 103 and a second open end portion 110 extends away from the second portion proximate the second end 105. The first and second open end portions 108, 110, respectively, can be looped around a user's arm and coupled together to secure the band 100 to the user's arm. In the illustrative embodiments, the first and second open end portions 108, 110, respectively, can be coupled together using mateable strips of Velcro® 112 on an outer facing surface of the strip 106 and a coupling device, such as a slider, or tri-glide, 109, coupled to the first open end portion 108. The second open end portion 110 can be threaded through the slider 109 and pulled back upon itself such that the mateable strips of Velcro® removably attach to themselves. To accommodate users with different arm sizes and shapes, the circumferential length of the arm band 100 can be adjusted by pulling more or less of the second open end portion 110 of the strip 106 through the slider 109.

Although not specifically shown, it is recognized that the first and second open end portions 108, 110, respectively, can be adjustably coupled together using other coupling or attachment devices commonly known in the art. For example, the first open end portion 108 can include a female portion of a buckle and the second open end portion 110 can include a male portion removably securable to the female portion to secure the band 100 about a user's arm.

For comfort and conformability, the webbing 102 can be attached to a padded liner 114 made from a resiliently flexible material, such as, but not limited to, Neoprene®. Further, the outer surface and edges of the liner 114 can be covered, for example, by a layer of meshed material.

Figure 7:
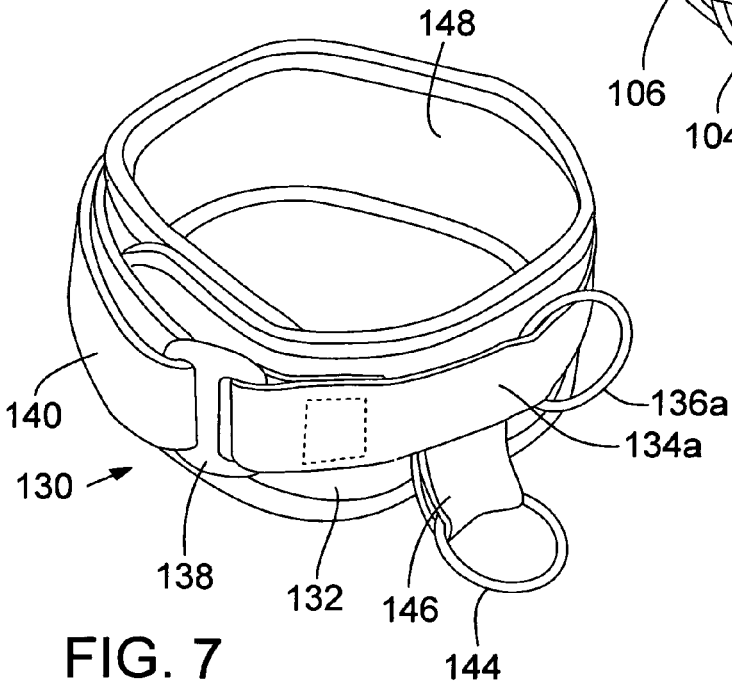
FIG. 7 is a perspective view of one of the leg bands of FIG. 1 in a closed configuration.
Figure 8:
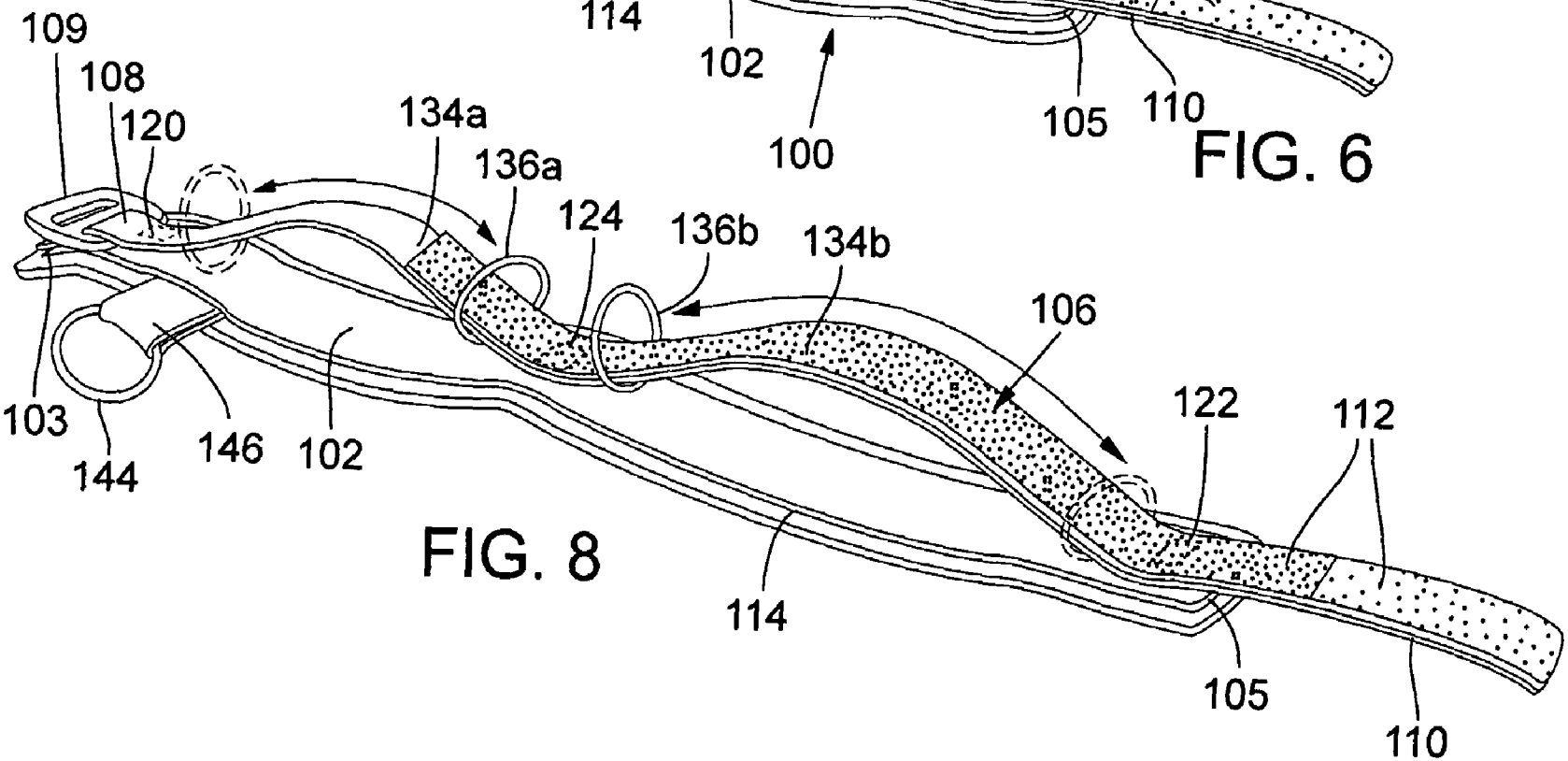
FIG. 8 is a perspective view of one of the leg bands of FIG. 1 in an open configuration.

Referring now to FIGS. 7 and 8, an exemplary embodiment of a leg band 130 is shown. The leg band 130 includes many of the same features as the arm band 100. Accordingly, those features shared between the arm band 100 and leg band 130 are labeled with the same reference numerals.

Leg band 130 can have an overall length greater than arm band 130 to accommodate the typically larger dimensions of a user's legs compared to the user's arms. Further, in some embodiments, as shown, a third portion 124 of the strip 106, intermediate the attached first and second portions 120, 122, respectively, can be attached to the webbing 102 intermediate the first and second ends 103, 105, respectively, of the webbing. The portion of the strip 106 intermediate the first attached portion 120 and the third attached portion 124 can define a first anchor guide **134*a* for anchor 136*a*, and the portion of the strip intermediate the second attached portion 122 and the third attached portion 124 can define a second anchor guide 134*b* for anchor 136*b*. The anchors 136*a*, 136*b* can be slidably movable along the first and second anchor guides 134*a*, 134*b***, respectively, independent of each other.

The leg band 130, and arm band 100, can have one or more anchors, such as anchor 144, pivotably attached to the webbing 102 via a strip 146 made from a durable material. The anchor 144 can be pivotably movable relative to the webbing, but is generally prevented from substantial circumferentially directed movement about the band 130.

The anchors, or rings, of the vest, such as rings 30-50, and arm and legs bands, such as rings 104, **136*a*, 136*b*, 144**, are configured to receive exercise attachments, such as resistance devices. A resistance device, as used herein, can be defined as any device capable of resisting movement away from an object to which the resistance device is coupled and/or assisting movement in a desired direction or placement in a desired position. Resistance devices can be, for example, cables, cords, tubing, rope, poles, rods, sticks or webbing anchored to one or more objects, such as a people, weights, walls, floors and exercise equipment, etc.

As mentioned above, each anchor is positioned on the vest 10 to promote a particular type of exercise or to promote strengthening or rehabilitation of a particular portion or portions of the body, such as one of various muscles or groups of muscles. One or more resistance devices can be attached to one or more of any number of rings on the vest depending on the particular type of exercise desired or the particular portion of the body for which strengthening is desired. Further, the arm bands 100 can be positioned on any of various locations along a user's arms and the leg bands 130 can be positioned on any of various locations along a user's legs to promote strengthening of a particular portion of the arms or legs, respectively, or a particular movement.

For example, a resistance device, e.g., a flexible, resilient and or elastic cord, such as a bungee-cord, can be attached to an anchor of the vest or bands to resist movement of a user wearing the vest or bands in a direction generally parallel to the cord. In one specific implementation, a bungee-cord can be attached to the upper spine anchor 44 of the vest 10 at a first end, extend generally parallel to horizontal from the anchor and be attached to a wall, or other stationary object, at a second end. The user can then move in a direction away from the wall until the bungee cord resists movement in that direction and urges the user towards the wall. Moving against or overcoming the resistance of the bungee-cord helps to develop or strengthen specific areas of the body, such as, for example, the leg muscles and abdominal muscles.

In another specific implementation, a resistance device, such as a bungee-cord, can be attached to a stationary or secure object at one end and the upper waist anchor 34*a* at another end. A user wearing the vest could then stand away from the object such that the bungee-cord is taut. The user could then rotate his or her torso relative to his or her legs with the bungee-cord resisting such movement. In this manner, the user can develop or strengthen his or her abdominal muscles, back muscles, or other muscle groups.

In yet another specific implementation, a resistance device, such as a bungee-cord, can be attached to a slidable anchor, such as slidable anchor 50 at a first end and an object at a second end. With the bungee cord taut, the user could engage in a particular strength and conditioning motion, such as laterally side-stepping to right and left. As the user laterally side-steps to the left, the anchor 50 slides toward the right side of the vest with the bungee cord capable of applying a resistance to such motion. As the user laterally side-steps to the right, the slidable anchor 50 slides toward the left side of the vest with the bungee cord likewise capable of applying a resistance to such motion. As can be recognized, as the user alternates between leftward and rightward motion, the slidable anchor 50 correspondingly slides to the right and left, respectively.

Similarly, a resistance device, such as a bungee cord, can be attached to one of the anchors, such as slidable anchor 104 or anchor 144, of the arm or leg bands 100, 130. As the user moved his or her arms and/or legs, the attached bungee cord can resist such movement. In implementations of the arm or leg bands 100, 130 having a slidable anchor, the anchor can slide circumferentially about the bands as the user moves his or her arms and/or legs.

As can be recognized, the slidable anchors of the vest, arm bands and leg bands can provide, for example, greater flexibility in the types of exercise movements available to a user and a more constant degree of resistance throughout a given exercise movement.

Figure 9:
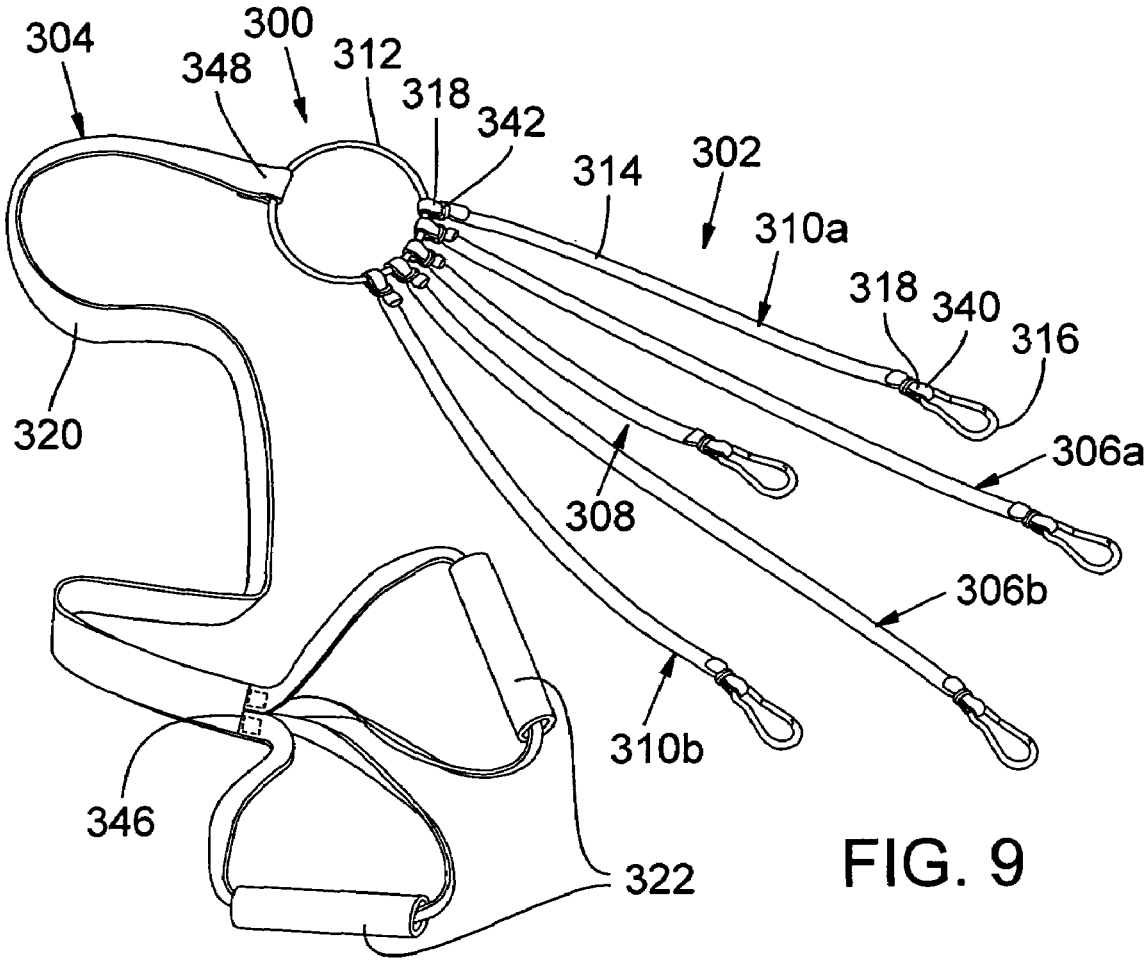
FIG. 9 is a perspective view of a resistance device attachable to the exercise vest, arm bands and/or leg bands of FIG. 1.
Figure 10:
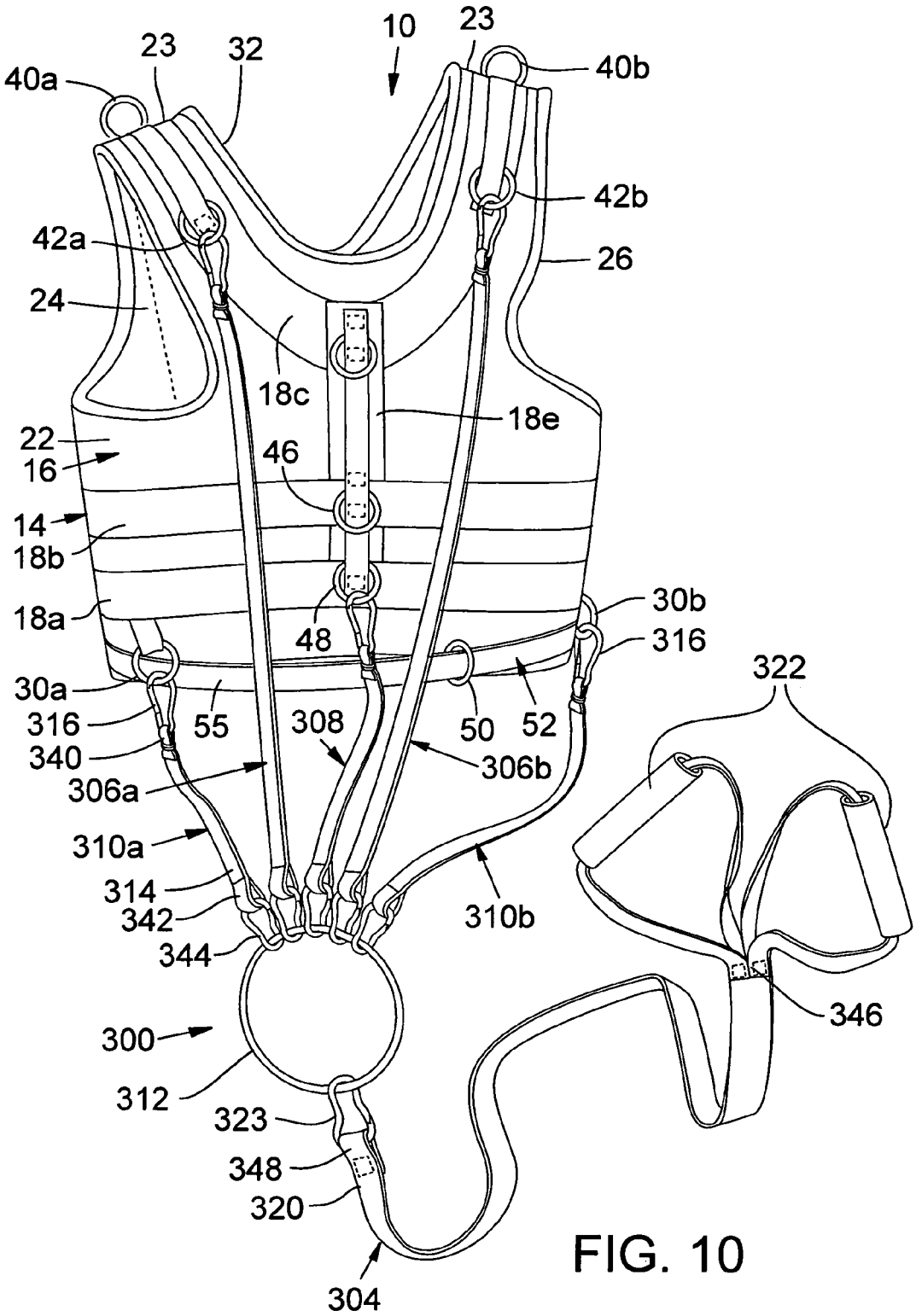
FIG. 10 is a perspective view of the resistance device of FIG. 9 attached to the exercise vest of FIG. 1.
Figure 11:
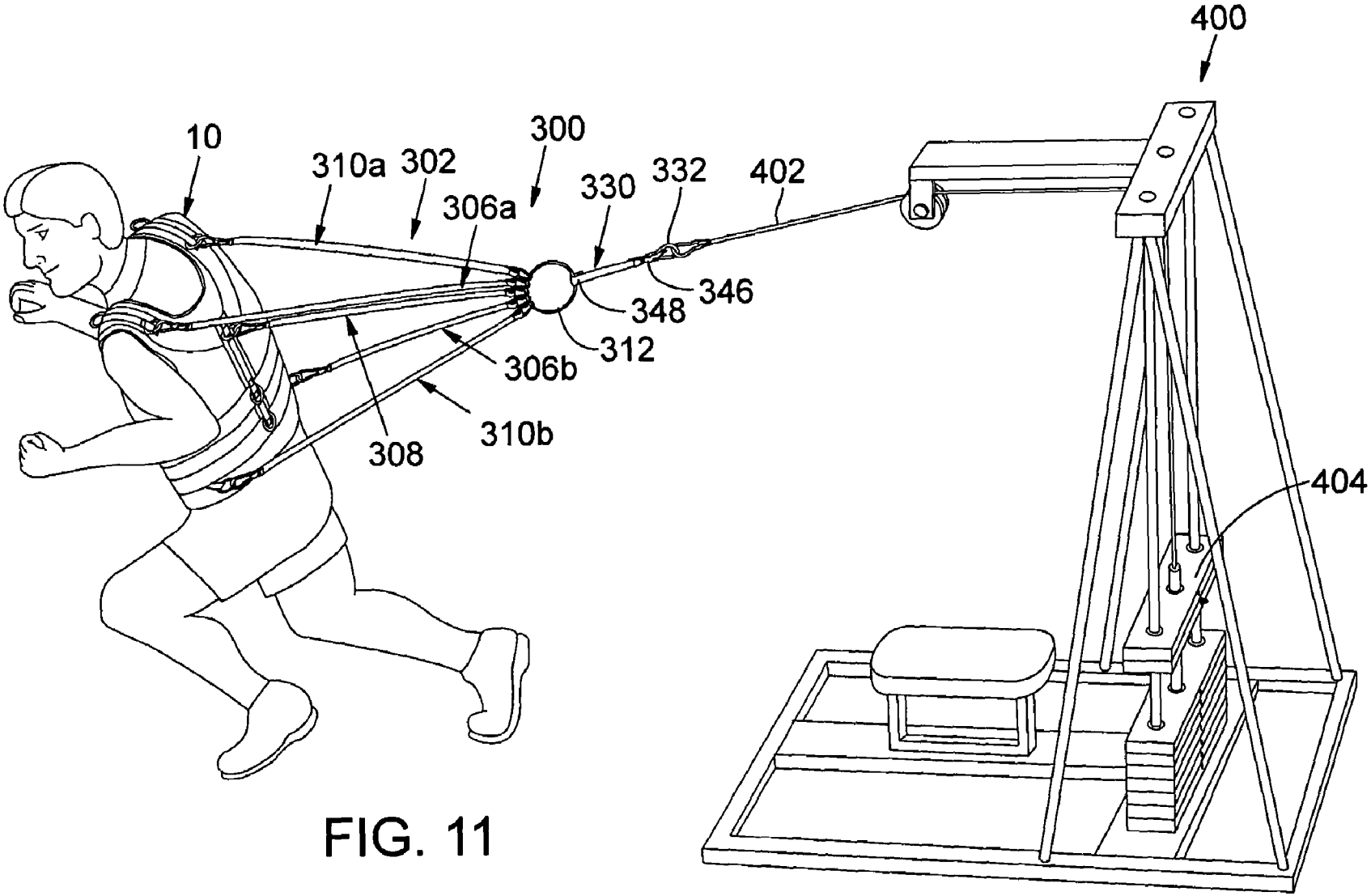
FIG. 11 is a perspective view of a person wearing the exercise vest of FIG. 1, the vest being coupled to an exercise machine via an exemplary embodiment of a resistance device having an exercise machine attachment.

According to one specific embodiment, the resistance device can be an exercise device 300 as shown in FIGS. 9-11. Exercise device 300 can include an anchor attachment section 302 coupled to an object attachment section 304 via a coupler, such as ring 312.

The anchor attachment section 302 can include one or more resistance cords, such as cords 306*a*, 306*b*, 308*a*, 308*b*, 310*a* and 310*b*. Preferably, each cord comprises a flexible, resilient and/or elastic length of material, such as exemplary bungee cord 314, capable of being removably coupled to an anchor at a first end, e.g., first end 340 of cord 310*a*, and a coupler, such as ring 312, at a second end, e.g., second end 342 of cord 310*a*.

In the illustrated embodiment of FIG. 9, the first end 340 of each cord 314 is irremovably secured to an attachment device, such as carabiner 316, for facilitating removable attachment to an anchor and the second end 342 is irremovably secured to the ring 312.

However, in some embodiments, such as shown in FIG. 10, the second end 342 is irremovably secured to an attachment device, such as carabiner 342. This configuration facilitates removable attachment of the first end 340 to an anchor of an exercise system, such as system 2, and the second end 342 to a coupler or ring 312. For example, depending on the desired exercise routine, a user could removably attach cords to the ring 312 or remove attached cords from the ring 312 to customize the user's workout.

Although the illustrative embodiments show the anchor attachment section 302 as having one or more resistance cords, it is recognized that the anchor attachment section can be comprised of one or more other objects capable of providing resistance, such as, but not limited to, cables, tubing, rope, poles, rods, sticks and webbing. For example, in some embodiments, the anchor attachment section can have safety sleeve devices, such as described in U.S. Pat. No. 6,202,263. A first end of the safety sleeve devices can be fixedly secured to the ring 312 and a second end of the safety sleeve devices can have a carabiner for removably attaching to an anchor.

In embodiments having an anchor attachment section with multiple resistance cords, or other resistance objects, such as shown in FIGS. 9-11, the cords/objects can have the same or different lengths and be configured in a particular order depending on the desired application or exercise. For example, as shown in an unstretched state in FIG. 9, cords 306*a*, 306*b* have a first length, cord 308 has a second length and cords 310*a*, 310*b* have a third length. In one specific exemplary implementation, the first, second and third lengths can be approximately 12, 18 and 24 inches, respectively. Of course, the anchor attachment section can have cords with any of various lengths. It is also recognized that the thickness or material of the resistance cords can be the same or different to produce the same or different resistances depending on the application or desired exercise/workout.

In the illustrated exemplary embodiment shown in FIG. 9, the cords can be ordered such that cords 306*a*, 306*b* are between cords 310*a*, 310*b* and cord 308 is between cords 306*a*, 306*b*. However, it is recognized that the cords can be arranged in any of various orders.

As shown in FIG. 9, object attachment section 304 can have an object attachment device, such as handles 322, at a first end 346 and be coupled to a coupler, e.g., ring 312, at a second end 348. The object attachment section 304 further includes a length of material 320 extending between the first and second ends 346, 348, respectively. The length of material 320 can be, for example, an elastic material, such as a bungee cord, but preferably is a non-elastic material, such as nylon webbing as described above. In some embodiments, as shown in FIG. 9, the second end 348 of the object attachment section 304 is permanently, or irremovably, attached to the coupler or ring 312. In other embodiments, such as shown in FIG. 10, the second end 348 of the object attachment section 304 can have an object attachment device, such as carabiner 323, clip, buckle, or Velcro® arrangement, for facilitating removable attachment of the second end 348 to the coupler, e.g., ring 312.

It is recognized that is some implementations, the coupler can be any object capable of receiving one or more anchor attachment devices of the anchor attachment section and one or more object attachment devices of the object attachment section. For example, the coupler can be a buckle, clip or other fastener arrangement known in the art.

In some embodiments, the object attachment device at the first end 346 of the object attachment section 304 can be permanently attached to the length of material 320. For example, the handles 322 shown in FIG. 9 and carabiner 332 shown in FIG. 11 are permanently attached to the first end 346 of the object attachment section 304, 330, respectively, such as by sewing.

Although not specifically shown, in some embodiments, the object attachment device at the first end 346 of the object attachment section 304 can be removably coupled to the length of material. This can be accomplished, for example, by attaching a first coupling device, such as a first carabiner, clip portion or buckle portion, to the length of material 320 proximate the first end 346 and attaching a second coupling device, such as a second carabiner, clip portion or buckle portion, to the object attachment device. The second coupling device can then be removably mateable with the first coupling device to removably couple the object attachment device to the length of material.

In use, the anchor attachment section of the exercise device can be coupled to at least one of the anchors of the vest 10, arm bands 100 or leg bands 130 worn by a user, and the object attachment section can be coupled to an object capable of providing at least some resistance to movement. The user can then participate in any of various exercises such that at least some resistance to movement is provided by the exercise device and/or the object.

For example, as shown in FIG. 10, in one specific embodiment, anchor attachment section 302 of the exercise device 300 is removably attached to vest 10 in a particular configuration. In other words, cords 306*a*, 306*b* are removably attached to anchors 42*a*, 42*b*, respectively, cord 308 is attached to anchor 48 and cords 310*a*, 310*b* are attached to anchors 30*a*, 30*b*, respectively. The handle 322 of the object attachment end 304 of the exercise device 300 can be grasped by a person other than the user. As the user moves while exercising, the person holding the handle 322 can provide resistance to such movement.

The configuration of cords and the anchors to which they are attached shown in FIGS. 10 and 11 are merely exemplary and it is recognized that any of various configurations can be implemented. For example, the four of the five cords of resistance device 300, as shown in FIG. 9, can be removably attached to anchors other than 30*a*, 30*b*, 42*a*, 42*b*, 48, such as anchors 34*a*, 34*b*, 36*a*, 36*b*, located on the front, and one of the cords can remain unattached to an anchor during use. Alternatively, all but one of the cords of the resistance device 300 can be unattached to an anchor of the vest 10, arm band 100 or leg band 130. Yet in other embodiments, two or more cords can be attached to a single anchor to provide additional resistance, such as for workouts involving a warm-up phase, where minimal resistance is needed, and a high impact phase, where additional resistance may be desired.

Further, in embodiments having removable cords, such as shown in FIG. 10, one or more of the five cords of resistance device 300 can be removed and the remaining cords can be attached to one or more of the various anchors of an exercise system component, such as vest 10, arm band 100 and leg band 130, described herein. Alternatively, one or more cords can be added to the resistance device 300 and removably attached to one or more anchors.

In another specific embodiment shown in FIG. 11, the anchor attachment section 302 of the exercise device 300 is removably attached to vest 10 in the same configuration as described above in relation to FIG. 10. The attachment device of the object attachment section 304 of FIG. 11, however, is not a handle to be grasped by another person, but is a carabiner 332 for removably attaching to a cord of an exercise machine, such as exercise machine 400, which in turn is attached to one or more weights 404 associated with the exercise machine. In this embodiment, as the user moves while exercising, the weights 404 of the exercise machine 400 provide at least some resistance to movement.

Specific cord/anchor configurations can promote a particular stance, action or exercise by the user. For example, with the cord/anchor configuration shown in FIGS. 10 and 11, the user can be naturally supported by an object in a sprinter's stance, similar to the stance of the user shown in FIG. 11. A sprinter looking to enhance his/her starting skills can be more naturally supported in the sprinter's stance can promote easier and more effective development of his/her starting block technique.

The highly modular and interchangeable nature of the various components of the exercise system described herein can facilitate a highly customizable workout or workout system. For example, a first object attachment device, such as handles 322 (see FIGS. 9 and 10), can be coupled to the length of material 320 such that a person can grip the handles and provide resistance to movement as the user performs a certain exercise. Upon conclusion of the exercise, the first object attachment device can be removed, and a second object attachment device, such as a carabiner, can be coupled to the length of material 320. The carabiner can then be attached to an exercise machine, such as exercise machine 400 shown in FIG. 11, and the user can perform a certain exercise with the weights providing at least some of the resistance to movement. The carabiner, can then be attached to a wall, such as by a wall mounted bracket or eyelet, such that the wall provides at least some of the resistance to movement during a workout.

The direction of resistance can be easily modified during a work-out. For example, in the above implementation having an object attachment section with a carabiner coupled to a wall at its first end, the carabiner can be detached from a first location on the wall and reattached to the wall at a second location. The user would then be resisted from movement in a slightly different direction to develop or strengthen different areas of the body or the same areas in a slightly different way.

As can be recognized, the vest 10, arm bands 100 and leg bands 130 can be adapted to be used with any of various resistance or assistance devices, at any of various angles or planes to develop or strengthen any of various muscle groups or other portions of the body. In other words, the vest 10, arms bands 100 and leg bands 130 are infinitely customizable to accommodate an infinite number of exercises or work-outs depending on the particular target area of the body a user would like to strengthen. Additionally, since the vest 10 arms bands 100 and leg bands 130 are made from relatively lightweight materials, and are not bulky in size, it can be worn during regular activities to strengthen particular body motions particular to the activity. For example, a golfer can wear the vest and or arm/leg bands while swinging a golf club or simulating a golf swing to develop a particular muscle group involved with swinging a golf club, such as the shoulder muscles, back muscles and/or leg muscles.

In view of the many possible embodiments to which the principles of the above disclosure may be applied, it should be recognized that the illustrated embodiments are only preferred examples and should not be limiting in scope. Rather, the scope is defined by the following claims. We therefore claim as our invention all that comes within the scope and spirit of these claims.

I claim:

1. An exercise vest comprising:

a front portion, a back portion, right and left side portions and right and left shoulder portions, the front portion comprising a right side open end portion detachably coupleable to a left side open end portion; and at least one anchor mechanism comprising (i) an anchor retaining member extending from a first location on the vest to a second location on the vest, the retaining member comprising an elongated body having a length, and first and second ends at opposite ends of the length being fixedly secured to the vest at the first and the second locations, respectively, and (ii) a repositionable anchor movably coupled to the anchor retaining member and configured to detachably receive one or more resistance devices, wherein the repositionable anchor is selectively movable between the first location and the second location anywhere alone a path defined by the anchor retaining member;

a shell section comprised of the front, back, right side, left side, right shoulder and left shoulder portions; and a frame section coupled to an external surface of the shell section and comprising at least a first length of webbing extending circumferentially around and attached to the front portion, back portion, right side portion and left side portion, and at least a second length of webbing extending longitudinally around and attached to the front portion, at least one of the right and left side shoulder portions, and the back portion, wherein the retaining member body extends at least around the back portion of the shell section and the opposite ends of the retaining member body are fixedly secured to the first length of webbing; and a plurality of stationary anchors each configured to detachably receive one or more resistance devices and each coupled to the second length of webbing by one or more retaining strips extending through the stationary anchors and being stitched to the second length of webbing, the one or more retaining strips comprising one or more strips of webbing.

2. The exercise vest of claim 1, wherein each of the plurality of stationary anchors is positioned adjacent one of the front, back, right side, left side, right shoulder or left shoulder portions.

3. The exercise vest of claim 2, wherein the plurality of stationary anchors comprises at least one stationary anchor adjacent each of the front, back, right side, left side, right shoulder and left shoulder portions.

4. The exercise vest of claim 2, wherein the plurality of stationary anchors comprises:

first and second stationary anchors adjacent the left side portion;

third and fourth stationary anchors adjacent the right side portion;

fifth and sixth stationary anchors adjacent a lower portion of the front portion;

seventh and eighth stationary anchors adjacent an upper portion of the front portion;

ninth and tenth stationary anchors adjacent an intermediate portion of the front portion between the fifth and sixth stationary anchors and the seventh and eighth stationary anchors;

an eleventh stationary anchor adjacent the left shoulder portion;

a twelfth stationary anchor adjacent the right shoulder portion;

a thirteenth stationary anchor adjacent an upper middle portion of the back portion;

a fourteenth stationary anchor adjacent a lower middle portion of the back portion;

a fifteenth stationary anchor adjacent an intermediate middle portion of the back portion between the thirteenth and fourteenth stationary anchors; and sixteenth and seventeenth stationary anchors adjacent the back portion between the eleventh and twelfth stationary anchors and the thirteenth stationary anchor.

5. The exercise vest of claim 1, wherein the first location is adjacent one of the front, back, right side and left side portions and the second location is adjacent another one of the front, back, right side and left side portions.

6. The exercise vest of claim 1, wherein a substantial portion of the shell section extending about the front portion is made of Neoprene.

7. The exercise vest of claim 1, wherein a substantial portion of the shell section extending about the back portion is made of a meshed fabric.

8. The exercise vest of claim 1, wherein the first and second length of webbing is made of Nylon.

9. The exercise vest of claim 1, wherein the repositionable anchor is slidably coupled to the anchor retaining member, and wherein the repositionable anchor is selectively slidable between the first location and the second location.

10. The exercise vest of claim 1, wherein the first location is adjacent the left side portion and the second location is adjacent the right side portion.

11. The exercise vest of claim 1, further comprising at least one weight pocket coupled to an interior surface of at least one of the front, back, right side and left side portions.

12. The exercise vest of claim 1, wherein the repositionable anchor has an opening and the elongated body extends through the opening in the repositionable anchor such that the repositionable anchor can slide along the length of the body between the first and the second locations.

13. The exercise vest of claim 1, wherein a portion of the retaining member intermediate the first and second ends is unattached to the vest to provide an anchor track for guiding movement of the repositionable anchor.

14. The exercise vest of claim 1, wherein the first location is adjacent the right side open end portion, the second location is adjacent the left side open end portion.

15. An exercise vest comprising:

a front portion, a back portion, right and left side portions and right and left shoulder portions, the front portion comprising a right side oven end portion detachably coupleable to a left side oven end portion; and at least one anchor mechanism comprising (i) an anchor retaining member extending from a first location on the vest to a second location on the vest, the retaining member comprising an elongated body having a length, and first and second ends at opposite ends of the length being fixedly secured to the vest at the first and the second locations, respectively, and (ii) a repositionable anchor movably coupled to the anchor retaining member and configured to detachably receive one or more resistance devices, wherein the repositionable anchor is selectively movable between the first location and the second location anywhere along a path defined by the anchor retaining member;

wherein the repositionable anchor comprises a first repositionable anchor, and the exercise vest further comprises a second repositionable anchor, wherein each of the first and the second repositionable anchors is movably coupled to the anchor retaining member, wherein the anchor retaining member is fixedly secured to the vest at one or more locations intermediate the first end and the second end so as to define at least a first anchor track and a second anchor track, and wherein the first repositionable anchor is movably coupled to the first anchor track, and the second repositionable anchor is movably coupled to the second anchor track.

16. The exercise vest of claim 15, wherein the anchor retaining member comprises a first anchor retaining member, and the vest further comprises a second anchor retaining member, wherein the second repositionable anchor is movably coupled to the second anchor retaining member.

17. An exercise vest comprising:

a front portion, a back portion, right and left side portions and right and left shoulder portions, the front portion comprising a right side open end portion detachably coupleable to a left side open end portion; and at least one anchor mechanism comprising (i) an anchor retaining member extending from a first location on the vest to a second location on the vest, the retaining member comprising an elongated body having a length, and first and second ends at opposite ends of the length being fixedly secured to the vest at the first and the second locations, respectively, and (ii) a repositionable anchor movably coupled to the anchor retaining member and configured to detachably receive one or more resistance devices, wherein the repositionable anchor is selectively movable between the first location and the second location anywhere along a path defined by the anchor retaining member;

a shell section, a frame section comprising one or more lengths of webbing, and at least one stationary anchor; and at least one corresponding stationary anchor retaining member extending through the at least one stationary anchor and haying a first end fixedly secured to the webbing of the frame section adjacent one of the front, back, right side, left side, right shoulder and left shoulder portion and a second end fixedly secured to the vest adjacent one of the front, back, right side, left side, right shoulder and left shoulder portion, wherein the at least one corresponding stationary anchor retaining member comprises a single strip of webbing having opposing ends and an intermediate portion disposed therebetween, the opposing ends and the intermediate portion secured to the webbing of the frame section so as to form at least first and second spaced apart stationary anchor retaining locations for retaining one or more respective stationary anchors, and wherein the at least one stationary anchor comprises at least a first stationary anchor secured by the anchor retaining member adjacent the first stationary anchor retaining location and a second stationary anchor secured by the anchor retaining member adjacent the second stationary anchor retaining location.

* * * * *